US011937712B2

(12) United States Patent
VanLeeuwen et al.

(10) Patent No.: US 11,937,712 B2
(45) Date of Patent: Mar. 26, 2024

(54) PAPER-BASED PEG HOOK

(71) Applicant: Menasha Corporation, Neenah, WI (US)

(72) Inventors: Mariah T. VanLeeuwen, Brampton (CA); Richard A. Wilson, Brampton (CA); Michael S. Wilcox, Brampton (CA); Andre N. Fortier, Brampton (CA)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 17/707,442

(22) Filed: Mar. 29, 2022

(65) Prior Publication Data

US 2023/0309716 A1 Oct. 5, 2023

(51) Int. Cl.
*A47F 5/00* (2006.01)
*A47F 5/08* (2006.01)

(52) U.S. Cl.
CPC ..... *A47F 5/0823* (2013.01)

(58) Field of Classification Search
None
See application file for complete search history.

(56) References Cited

U.S. PATENT DOCUMENTS

| | | | | |
|---|---|---|---|---|
| 597,230 | A * | 1/1898 | Weston | A47F 5/0823 402/14 |
| 2,649,796 | A * | 8/1953 | Zalkind | B42F 19/00 40/641 |
| 9,867,483 | B2 * | 1/2018 | Shea | G09F 23/06 |
| 2009/0010574 | A1 * | 1/2009 | Prescott | B65D 33/14 383/105 |
| 2009/0256041 | A1 * | 10/2009 | Fox | A47F 5/0823 248/220.21 |
| 2021/0259437 | A1 * | 8/2021 | Tasch | B65D 75/56 |
| 2022/0248875 | A1 | 8/2022 | Fenerty | |

* cited by examiner

*Primary Examiner* — Steven M Marsh
(74) *Attorney, Agent, or Firm* — Greensfelder, Hemker & Gale P.C.; Richard C. Himelhoch

(57) ABSTRACT

An environmentally friendly peg hook made from a paper based material that can be used on a display. The paper material can be recycled or is degradable in a land fill. The peg hook includes an anchor structure for securing the peg hook to a wall of a display through a slot in the wall. The peg hook can include a single hook structure or multiple hook structures in a single row or multiple rows.

4 Claims, 11 Drawing Sheets

PAPER-BASED PEG HOOK

CROSS-REFERENCE TO RELATED APPLICATIONS

None.

FEDERALLY SPONSORED RESEARCH OR DEVELOPMENT

N/A

FIELD OF THE INVENTION

The present invention generally relates to a paper based hook structure for holding product on a display, and more particularly, to a paper based peg hook structure that extends outward from a back wall of a display for supporting multiple items.

DESCRIPTION OF THE PRIOR ART

Hooks that are used to hold goods on displays have historically been formed from plastic or metal materials. These materials can be expensive given the large number of hooks needed. Additionally, while most metal and certain plastics can be recycled, it is necessary to remove them from the displays even if the display is made from a recyclable material like paperboard. In most instances, the hooks are thrown out with the displays and can linger in landfills for years.

The present invention provides a peg hook structure that can be easily recycled (especially with a paper display) or which will degrade quickly if thrown out.

SUMMARY OF THE INVENTION

The present invention provides an environmentally friendly solution to current plastic peg hooks used for displays. A sustainable paper based peg hook structure is provided for holding multiple items on a display. The peg hook can be utilized on permanent or temporary display fixtures. Unlike plastic hooks, paper based materials are easier to recycle and will break down quickly in landfills.

In accordance with one aspect of the invention, an environmentally friendly hook comprises a paper anchor for securing the hook to a display and a paper support structure extending outward from a first end proximate the anchor to a second distal end. The support structure is configured to hold items hanging from the support structure.

The anchor is flat and includes an upper channel and a lower cutout. The upper channel and the lower cutout separate the anchor into a first portion for positioning behind a wall in the display and a second portion for positioning in front of the wall of the display.

The support structure can be an elongated beam that extends generally horizontal when the hook is secured to the display. The elongated beam can include an upwardly extending portion at the distal end.

The peg hook can include a detachable slot blocking segment extending from the elongated beam. The slot blocking segment includes a channel for engaging the upper channel of the anchor.

The peg hook can be formed from multiple layers of paperboard. For example, the hook can be formed from three layers of paperboard glued together. More or fewer layers can be implemented as necessary or desired for a particular use.

In accordance with another aspect of the invention, an environmentally friendly multiple peg hook is provided. The multiple peg hook comprises a paper top support, a plurality of paper hooks extending below the top support and a paper anchor for securing the hook to a display. The top support, first plurality of paper hook portions and second plurality of paper hook portions can be part of a single blank of material. The plurality of paper hooks can be four hooks in a single row.

The plurality of paper hooks can include a first plurality of paper hook portions connected to a second plurality of paper hook portions. The first plurality of paper hook portions can be connected to a first side of the top support and the second plurality of paper hook portions can be connected to a second side of the top support.

The multiple peg hook can include a front wall extending downward from an end of the top support. The anchor can be connected to one of the plurality of hooks at the back end of the peg hook.

In accordance with yet another aspect of the invention, an environmentally friendly hook having multiple rows of hooks for use on a display is provided. The hook comprises a paper lower support structure, a first row of paper hook portions supported by the lower support structure and a second row of paper hook portions supported by the lower support structure. The paper lower support structure, the first row of paper hook portions and the second row of paper hook portions can be formed from a single blank of paper material.

The hook also includes a paper anchor for connecting the hook to a wall of display. Additionally, the hook further comprises a paper front wall and paper side walls connected to the lower support structure.

The hook can include a first hook segment which has a first hook from the first row of paper hooks and a first hook from the second row of paper hooks. Additionally, the hook can include a plurality of hook segments, each having a hook in the first row and a hook in the second row.

Other features and advantages of the invention will be apparent from the following specification taken in conjunction with the following Figures.

BRIEF DESCRIPTION OF THE DRAWINGS

To understand the present invention, it will now be described by way of example, with reference to the accompanying drawings in which.

DETAILED DESCRIPTION

Figure 1:
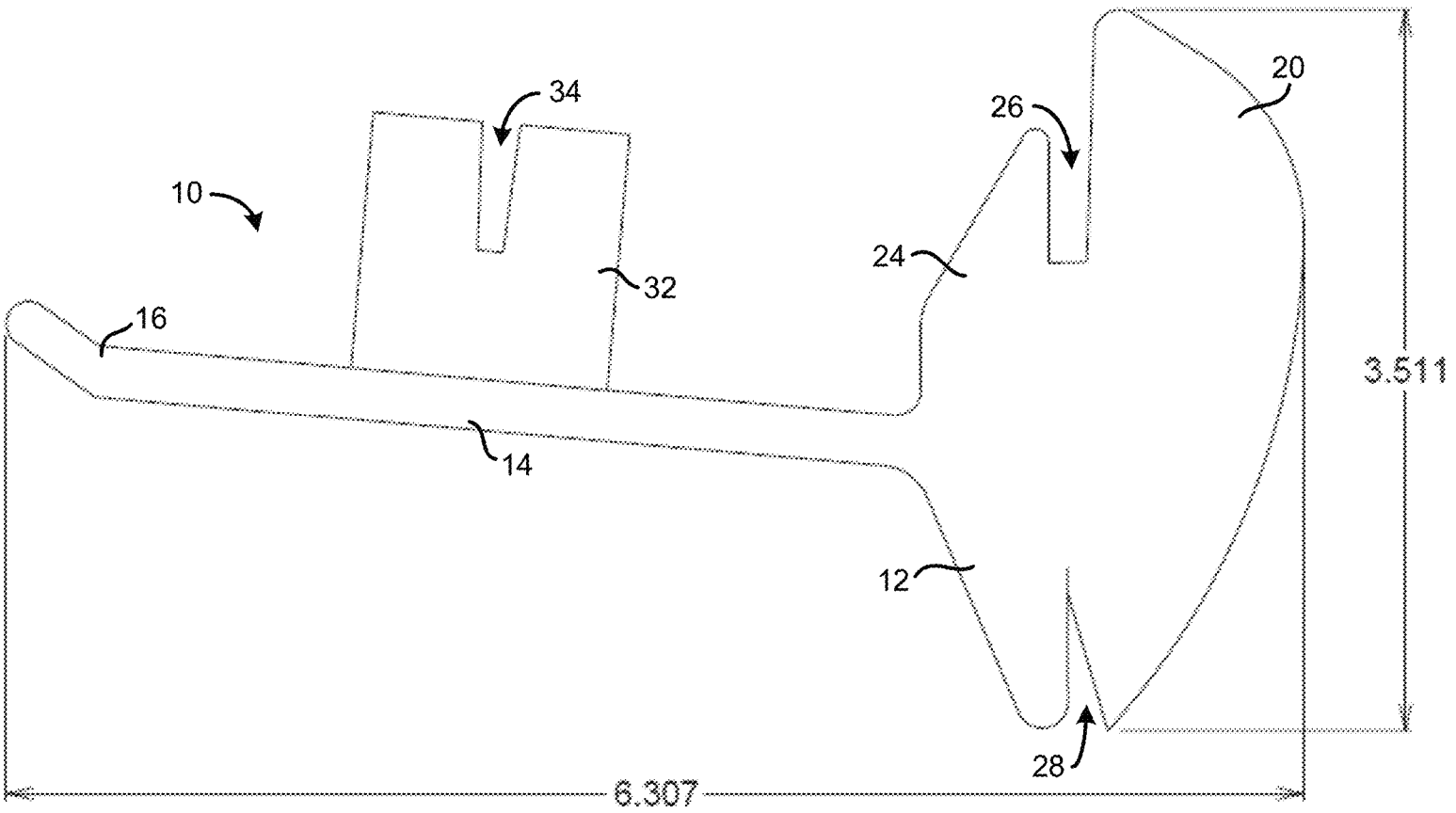
FIG. 1 is a schematic view of a first blank for a paper based peg hook in accordance with one aspect of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
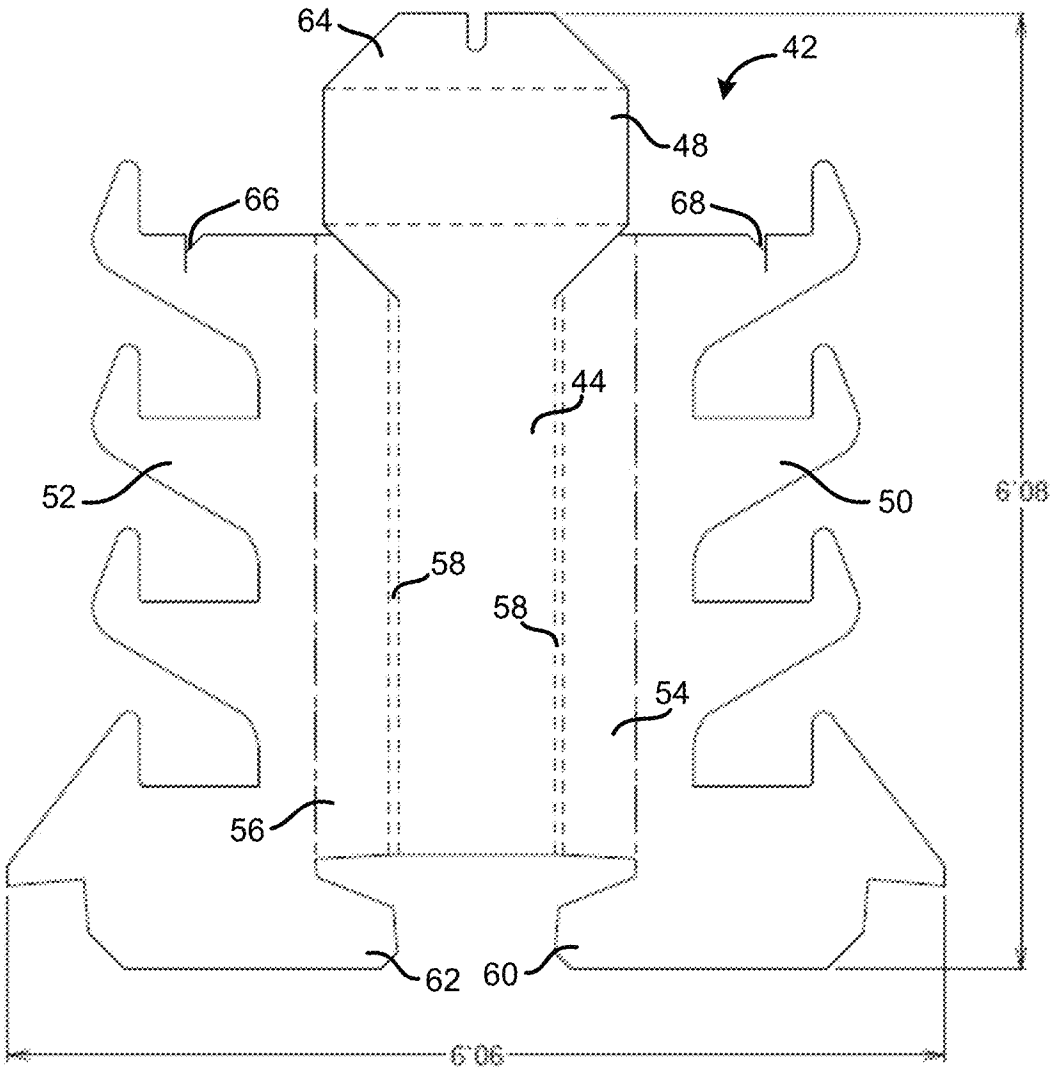
FIG. 2 is a schematic view of a second blank for a paper based peg hook in accordance with one aspect of the present invention.
Figure 3:
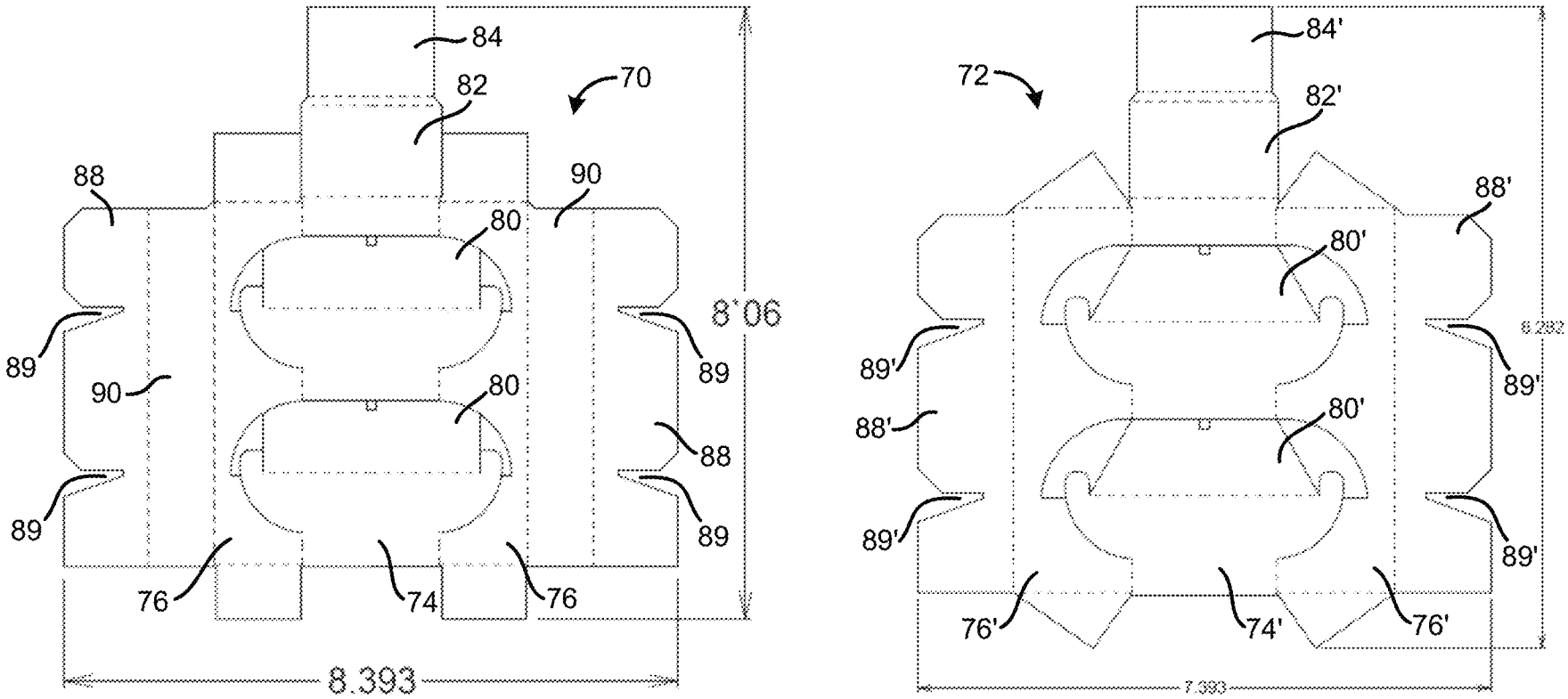
FIG. 3 is a schematic view of a third and a fourth blank for a paper based peg hook in accordance with one aspect of the present invention.

The present invention is directed to peg hooks for displaying goods that are made from a paper material. The material can include cardboard, corrugated paper materials, laminated paper materials, and other similar paper related materials. The paper hooks can be recycled, or if thrown away, are biodegradable and environmentally friendly. FIGS. 1-3 illustrate three blanks of paper material that can be used to form the hooks.

Figure 4:
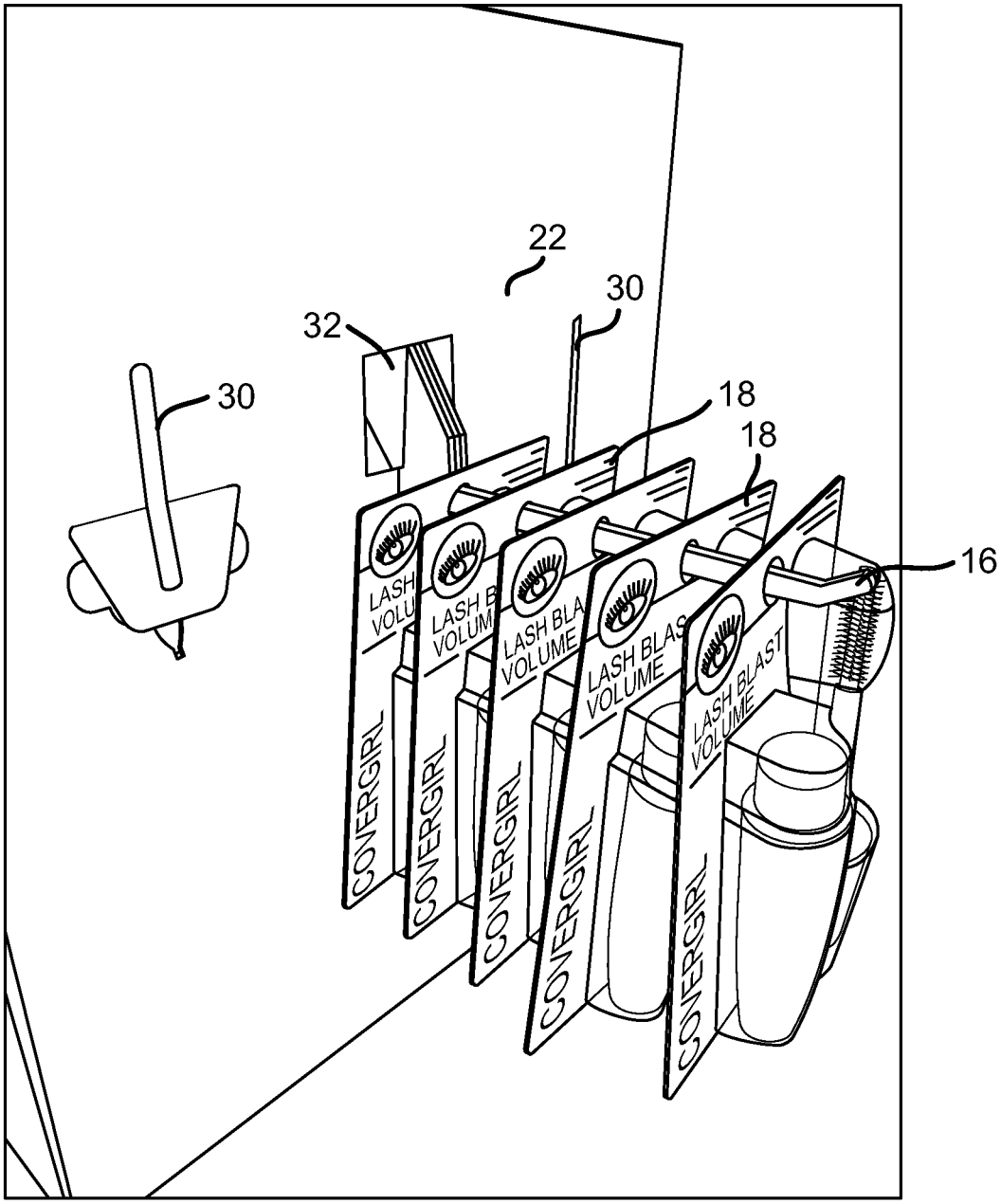
FIG. 4 is a perspective view of the peg hook of FIG. 1 mounted to a display and holding product.
Figure 5:
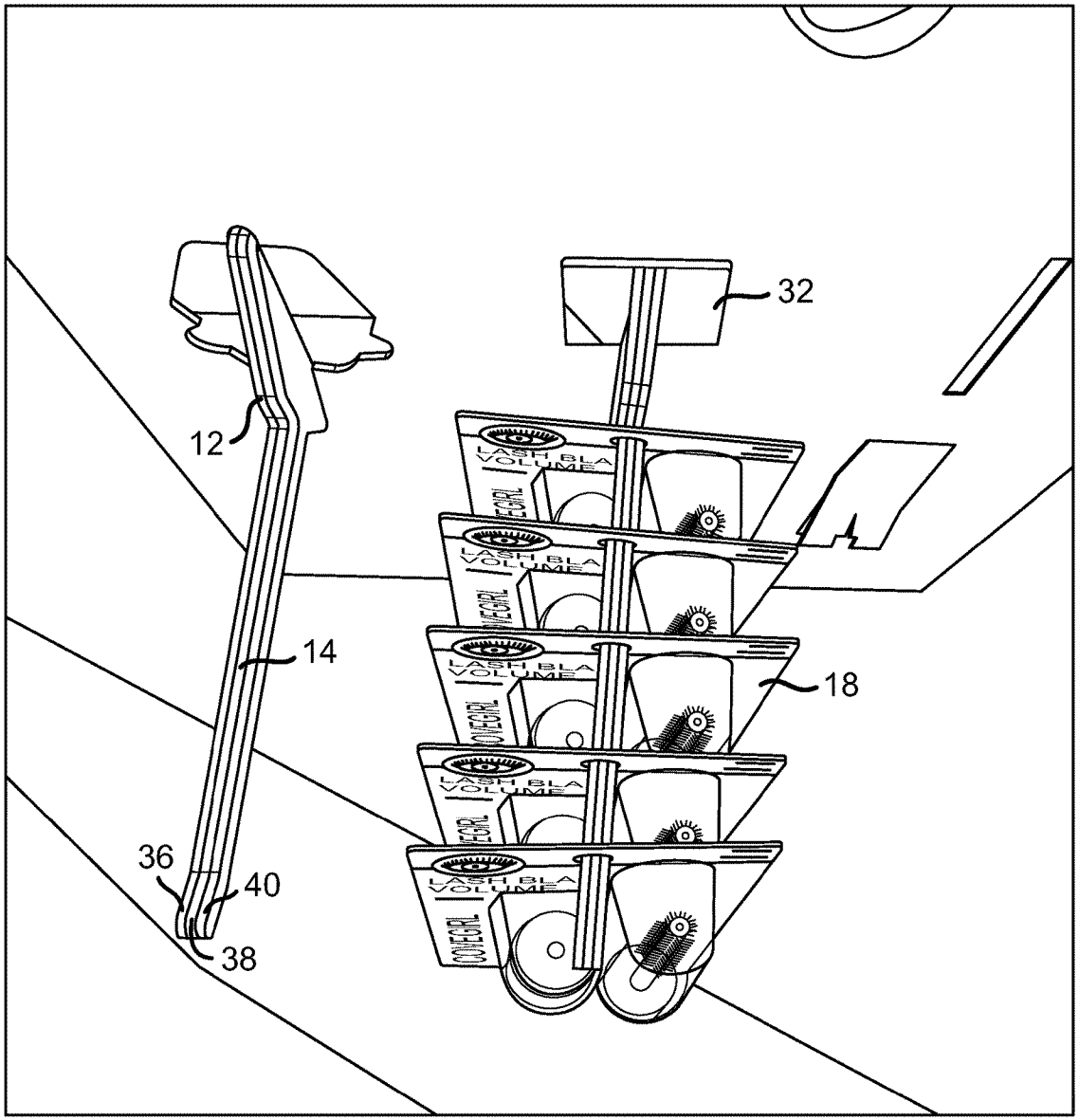
FIG. 5 is a top view of the two peg hooks of FIG. 1 mounted to a display, one of which is holding product.
Figure 6:
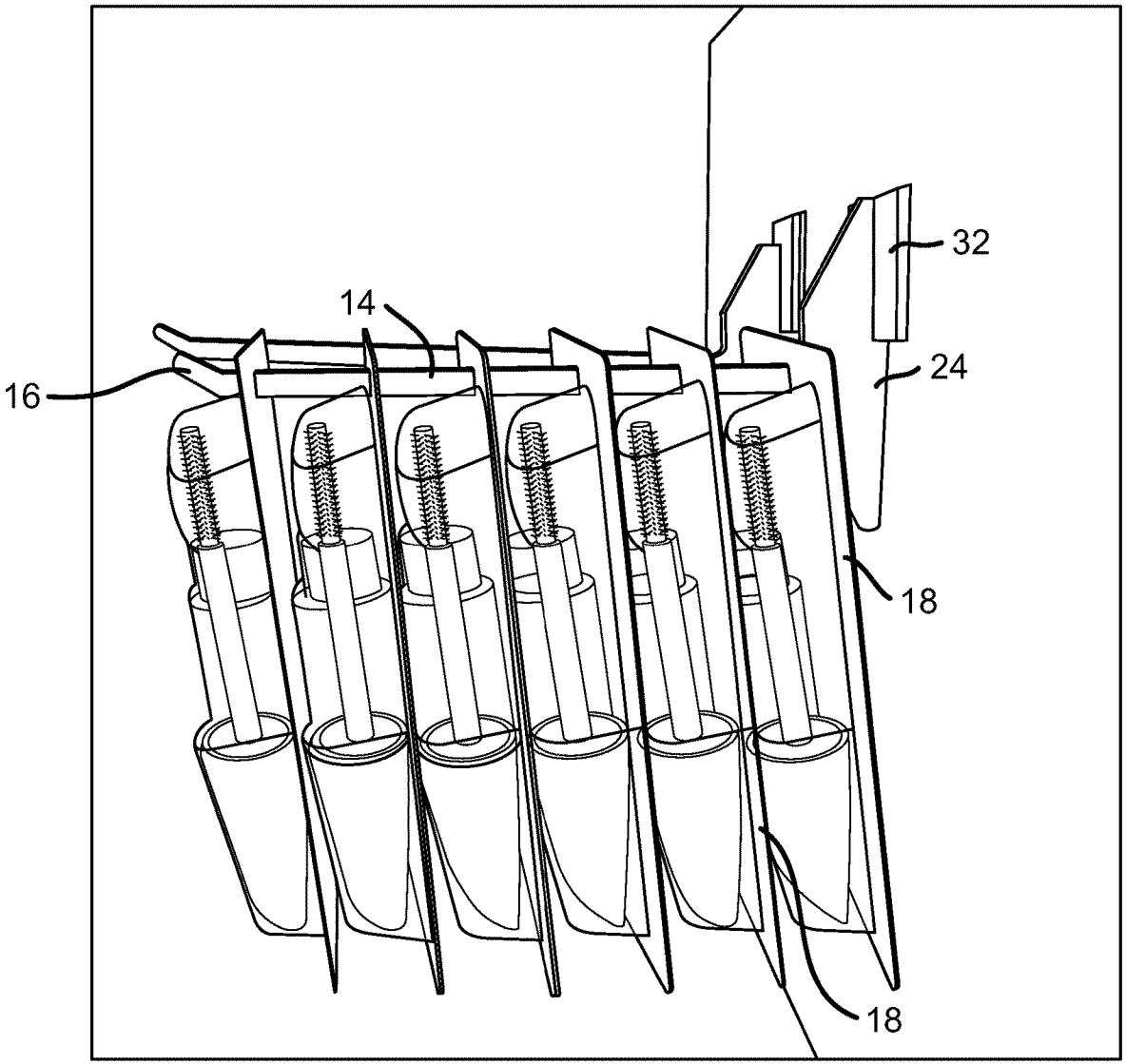
FIG. 6 is a side view of the peg hooks of FIG. 5.

FIG. 1 shows a first blank of a paper based peg hook 10. FIGS. 4-6 show the first paper based peg hook 10 connected to a display. The peg hook 10 includes an anchor portion 12 and a hook or support structure 14 projecting outward from the anchor portion 12. The anchor portion 12 is used to secure the peg hook 10 to a wall of a display (historically, such walls were made of peg board having a plurality of holes—pegs connected to hooks and other similar structures could be secured to the board using one or more of the holes). The support structure 14 is an elongated beam that extends essentially horizontally (when the anchor portion is secured to the wall of the display) and includes an upwardly extending or inclined portion 16 at an end distal from the anchor portion 12. The support structure 14 can be used to support or hold product 18 to be displayed.

The anchor portion 12 includes a first portion 20 that is position-able behind a wall 22 of the display and a second portion 24 that is positioned in front of the wall 22. A top channel 26 separates an upper portion of the first portion 20 from an upper portion of the second portion 24 of the anchor portion 12, and a lower channel 28 separates a lower portion of the first portion 20 from a lower portion of the second portion 24 of the anchor portion 12. The top channel 26 has a generally rectangular configuration and the lower channel 28 has a generally triangular configuration.

To secure the peg hook 10 to the wall 22 of the display, the first portion 20 of the anchor portion is inserted through a slot 30 on the wall 22. The anchor portion 12 is then pushed down to wedge the bottom edge of the slot into the lower channel 28 so that the lower portion of the second portion 24 of the anchor portion 12 is positioned against the outer surface of the wall 22 just below the bottom edge of the slot.

As shown in FIGS. 4-6, a slot blocking segment 32 can be inserted into the top channel 26 of the anchor portion 12. The slot blocking segment 32 extends outward beyond the width of the slot 30 to prevent the upper portion of the second portion 24 of the anchor portion 12 from falling though the slot 30 and locking the peg hook 10 in place. The slot blocking segment 32 includes a channel 34 that will interlock with the top channel 26 of the anchor portion 12. The slot blocking segment 32 can be separate from the peg hook 10, or it can be detachably connected to the peg hook 10 as shown in FIG. 1.

Referring to FIG. 5, the peg hook 10 is shown having three layers 36, 38, 40 of a thick cardboard. Depending on the thickness of the material and the desired end use of the peg hook 10, fewer or more layers could be used. Moreover, other similar paper based materials can be used. The layers 36, 38, 40 are preferably glued together.

Figure 7:
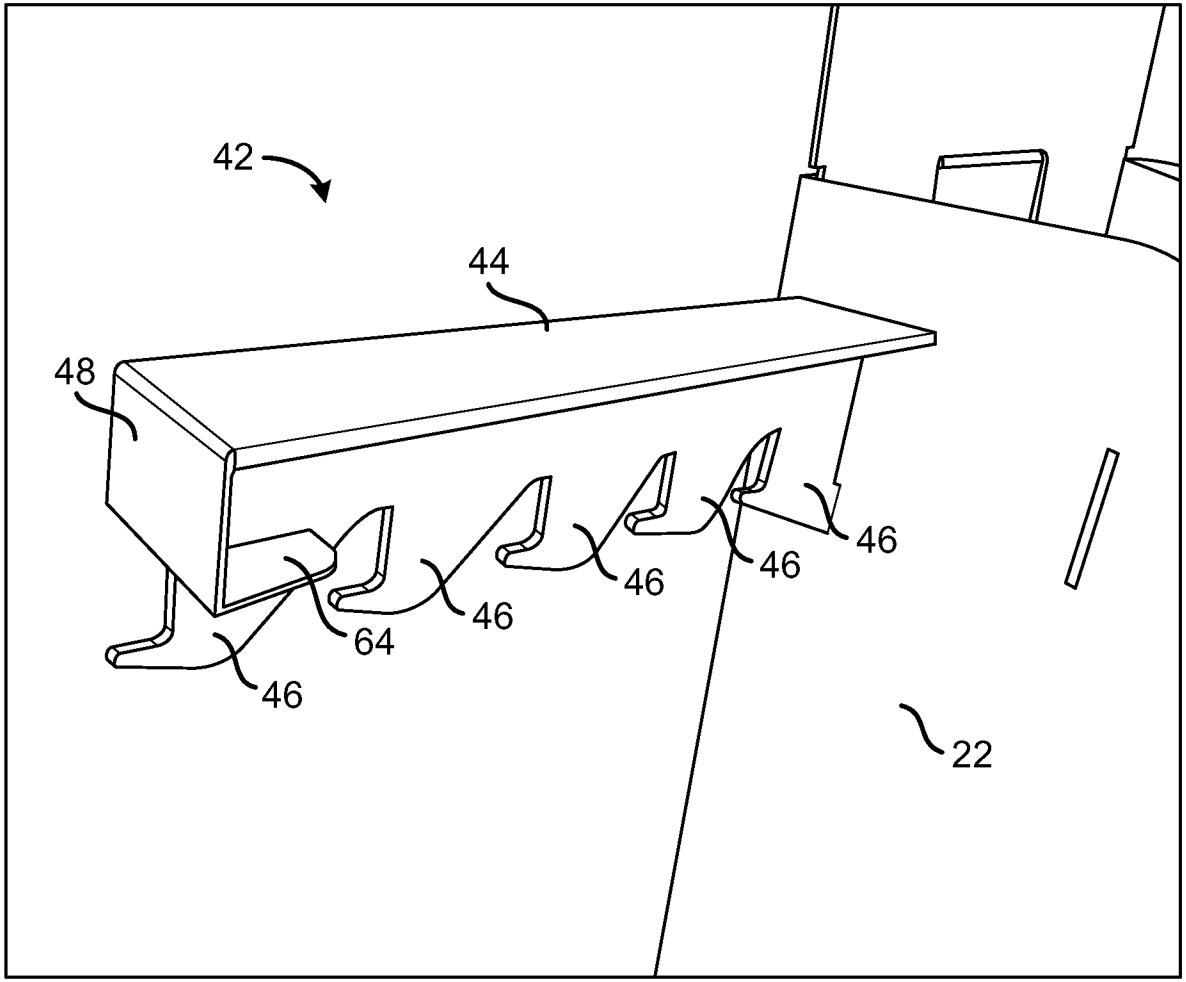
FIG. 7 is a perspective view of the peg hook of FIG. 2 connected to a wall of a display.
Figure 8:
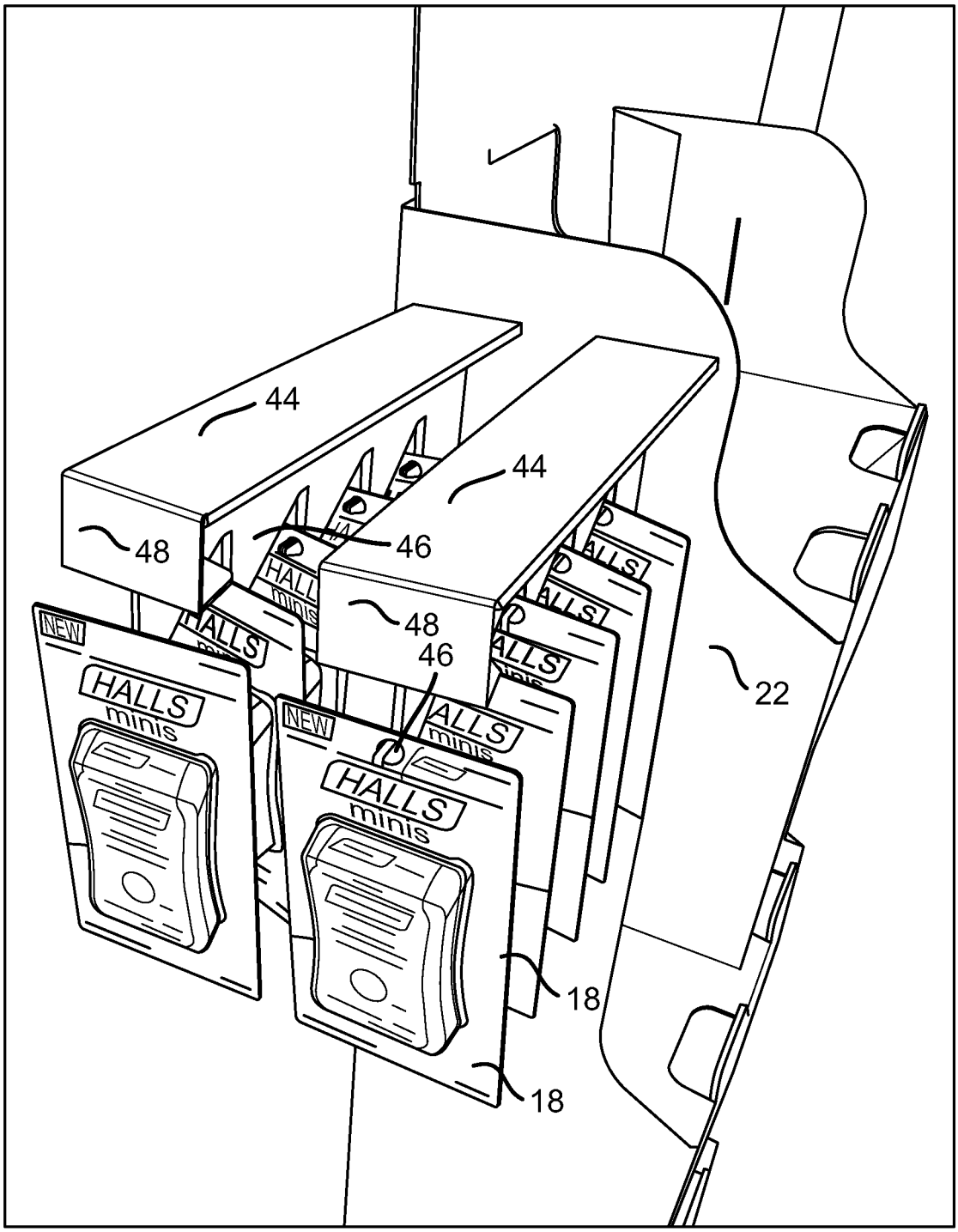
FIG. 8 is a perspective view of two peg hooks of FIG. 2 with goods connected to a wall of a display.

FIG. 2 shows a second blank for a second paper based peg hook 42 for supporting goods on a display. FIGS. 7-8 show the second peg hook 42 on a display. The second peg hook 42 includes a generally rectangular top support structure 44 and a plurality of separate hook structures 46 extending downward from the top support structure 44. The hook structures 46 are in a row projecting outward from the wall 22 of the display. A front wall 48 extends downward from an end of the top support structure 44 distal from the wall 22.

Referring to the blank of the peg hook 42 in FIG. 2, the top support structure 44 is connected to a first hook portion 50 on a first side and a second hook portion 52 on a second side. The two hook portions 50, 52 are combined to form the plurality of hook structures 46.

Specifically, the hook portions 50, 52 are each connected at (what will turn into) a top edge to one of two bottom panels 54, 56, respectively, that are connected to the top support structure 44 by a double fold line 58. The double fold line 58 enables the bottom panels 54, 56 to fold 180 degrees so that each is positioned immediately below and parallel to the top structure 44. The bottom panels 54, 56 are sized so that each positions the hook portions 50, 52 midway between the sides of the support structure 44. The hook portions 50, 52 can be folded 90 degrees from the bottom panels 54, 56 and abut each other to form the plurality of hook structures 46 having a double thickness of material.

The end of each hook portion 50, 52 includes an anchor portion 60, 62. The anchor portions 60, 62 also combine to form an anchor of double thickness that is used to secure the peg hook 42 to the wall 22 through a slot 30. The front wall 48 can include an end flap 64 that can be folded back into slots 66, 68 in the front-most portion of the hook portions 50, 52 to secure the front wall 48 in place.

FIG. 8 shows two of the peg hooks 42 holding goods 18. Each good 18 is on its own hook structure 46.

FIG. 3 shows a third blank for a paper based peg hook 70 and a slightly modified fourth blank for a paper based peg hook 72. FIGS. 9-12 show perspective views of the constructed peg hooks 70, 72. The peg hooks 70, 72 each include a bottom support structure 74, 74' and rigid side walls 76, 76' that maintain two rows of spaced apart hook structures 78, 78'.

The bottom support structure 74, 74' includes moveable flaps 80, 80' that rotate upward to a vertical position to expose the hook structures 78, 78' on each side of the flap 80, 80'. The flaps 80, 80' are held in place by the shape of cut outs in the side walls 76, 76' and by outer panels 88, 88' that are folded back into the interior of the hook 70, 72. The outer flaps 88, 88' include slots 89, 89' which receive the moveable flaps 80, 80' when the moveable flaps 80, 80' are in the vertical position.

The peg hooks 70, 72 also include front walls 82, 82' held in place by fold over flaps 84, 84'. Additionally, the peg hooks 70 of the third blank include top panels 90 connected to each side wall 76.

Figure 9:
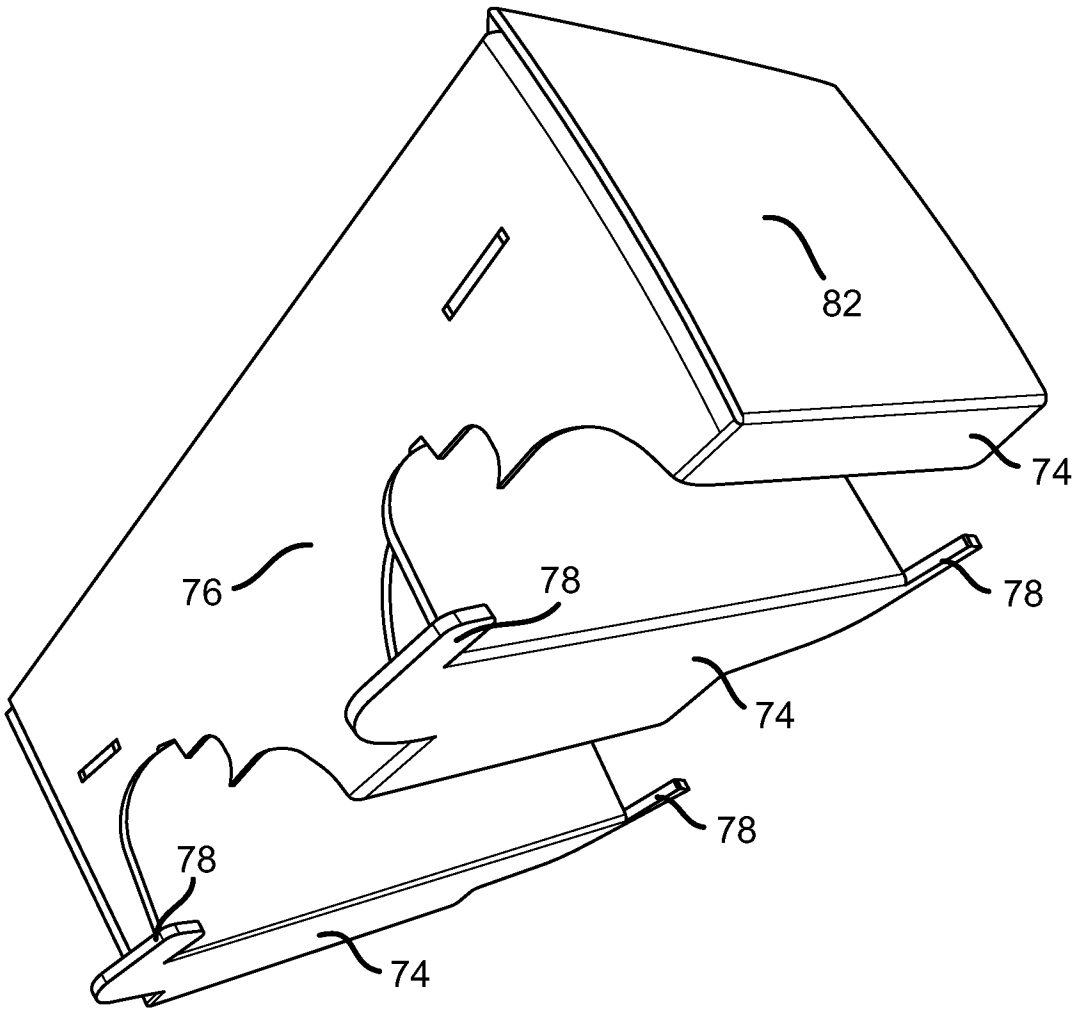
FIG. 9 is a perspective view of a peg hook in accordance with the third blank of FIG. 3.
Figure 10:
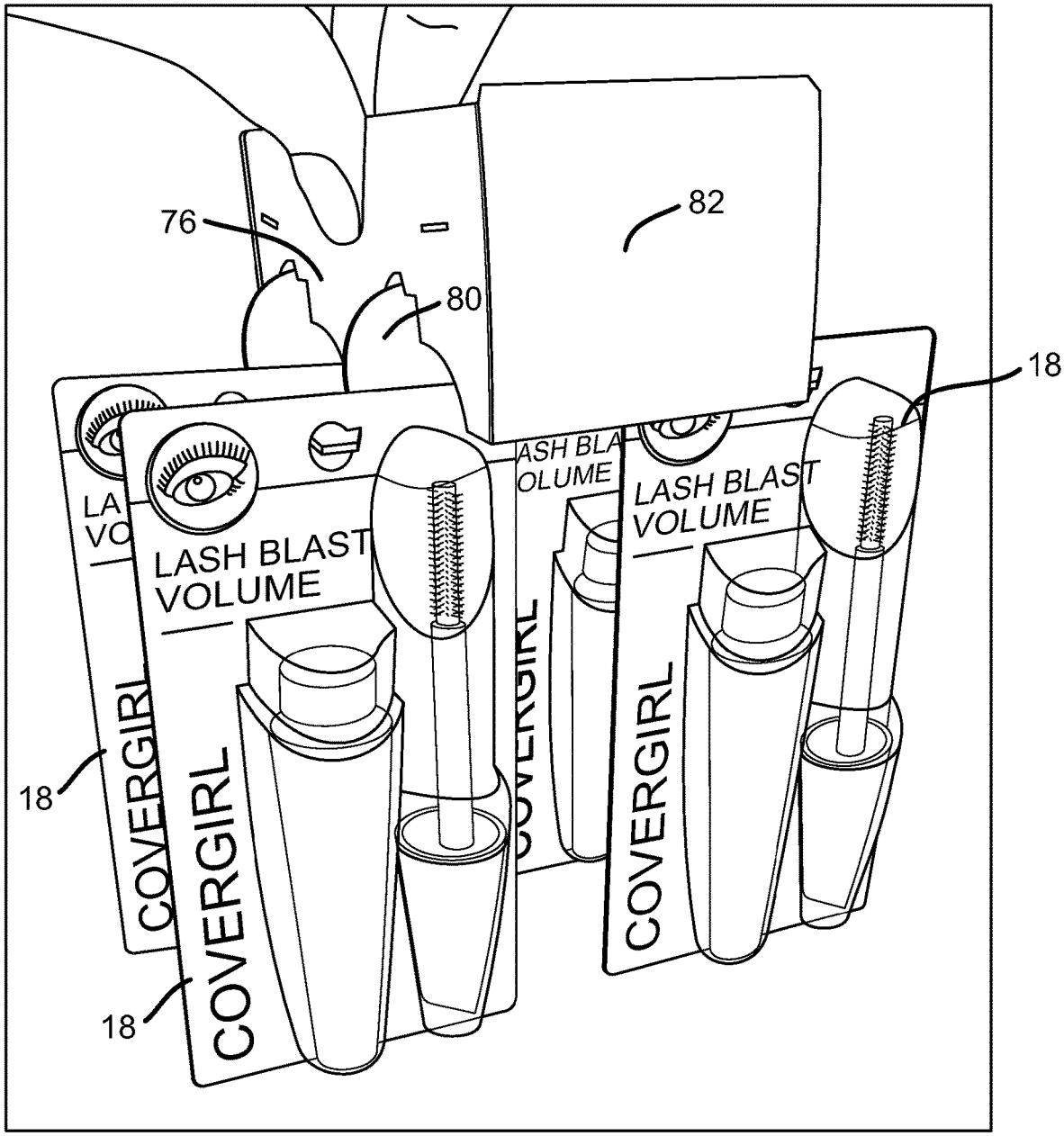
FIG. 10 is a perspective view of a peg hook in accordance with the third blank of FIG. 3 holding goods.
Figures 11, 12:
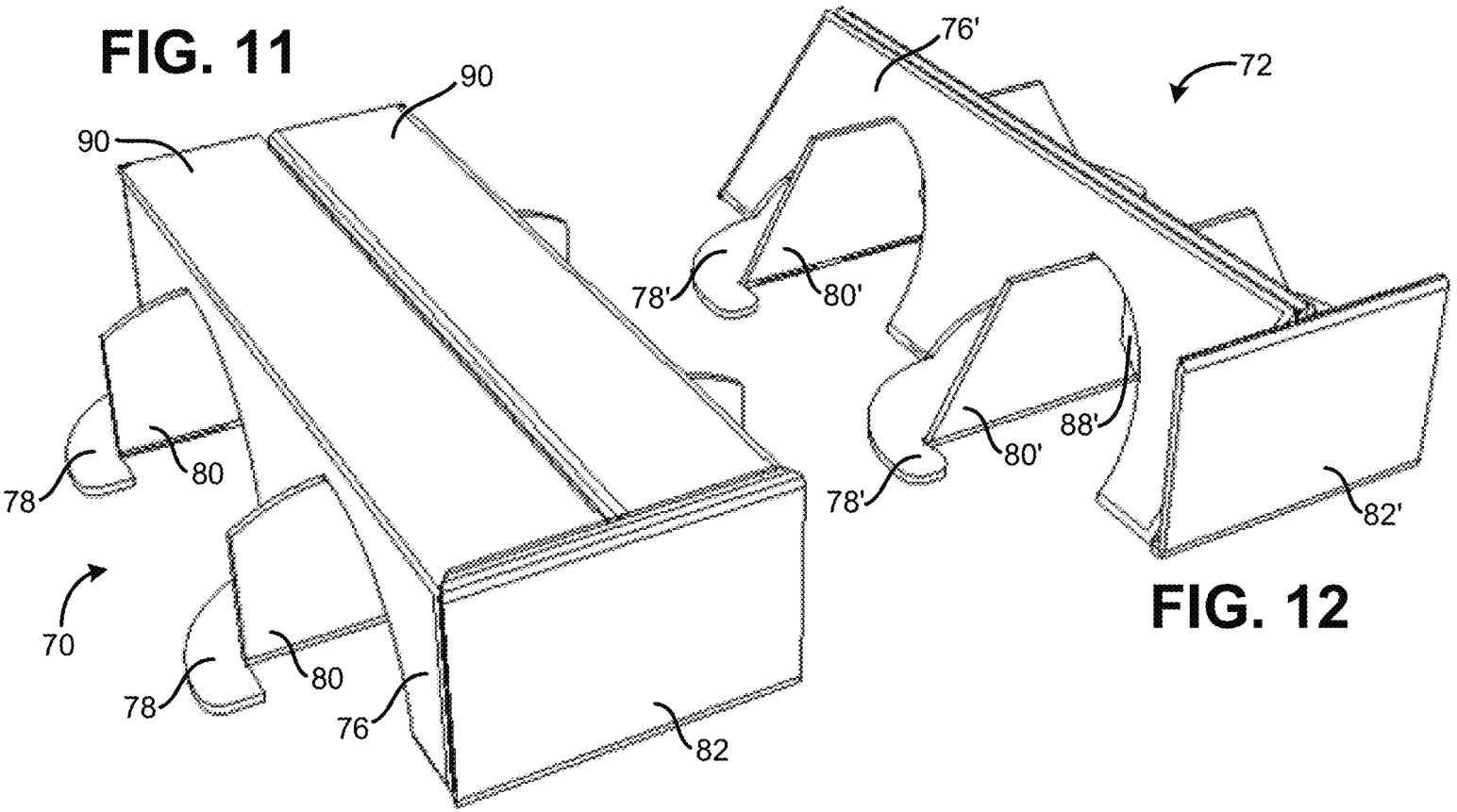
FIG. 11 is a perspective view of a peg hook in accordance with the third blank of FIG. 3 slightly modified; and, FIG. 12 is a perspective view of a peg hook in accordance with the fourth blank of FIG. 3.

As shown in FIGS. 9-11, the third peg hook 70 has a generally boxy configuration. The fourth peg hook 72, shown in FIG. 12 has a triangular body portion extending from the front wall 82'. The front wall 82' can be modified to conform to the shape of the body if desired. Anchors can be provided to connect the peg hooks 70, 72 to a wall of a display.

Many modifications and variations of the present invention are possible in light of the above teachings. It is, therefore, to be understood within the scope of the appended claims the invention may be protected otherwise than as specifically described.

We claim:

1. An environmentally friendly hook comprising:

a paper anchor for securing the hook to a display, wherein the anchor is flat and includes an upper channel and a lower cutout, the upper channel and the lower cutout separating the anchor into a first portion for positioning behind a wall in the display and a second portion for positioning in front of the wall of the display;

a paper support structure extending outward from a first end proximate the anchor to a second distal end, the support structure configured to hold items hanging from the support structure, wherein the support structure is an elongated beam that extends generally horizontal when the hook is secured to the display; and, a detachable slot blocking segment extending from the hook, wherein the detachable slot blocking segment extends from the elongated beam, and the slot blocking segment includes a channel for engaging the upper channel of the anchor.

2. The hook of claim 1 wherein the elongated beam includes an upwardly extending portion at the distal end.

3. The hook of claim 1 wherein the hook is formed from multiple layers of paperboard.

4. The hook of claim 3 wherein the hook is formed from three layers of paperboard glued together.

* * * * *